US006685041B1

(12) United States Patent
Geisinger

(10) Patent No.: US 6,685,041 B1
(45) Date of Patent: Feb. 3, 2004

(54) DUAL-CHAMBER CONTAINER AND CLOSURE PACKAGE

(75) Inventor: Gregory A. Geisinger, Toledo, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 80 days.

(21) Appl. No.: 09/961,960

(22) Filed: Sep. 24, 2001

(51) Int. Cl.[7] ..... B65D 1/04; B65D 41/28

(52) U.S. Cl. ..... 215/6; 215/235; 220/555; 222/94; 222/485; 264/516

(58) Field of Search ..... 220/555, 523, 220/553, 254.3, 254.2, 526; 215/6, 235, 244; 222/107, 485, 94; 264/516

(56) References Cited

U.S. PATENT DOCUMENTS

| | | | | |
|---|---|---|---|---|
| 2,940,120 A | | 9/1960 | Grebowiec | |
| 3,124,281 A | | 3/1964 | Stull | |
| 3,276,642 A | | 10/1966 | Johnson, Jr. et al. | |
| 3,394,861 A | * | 7/1968 | Truax | 229/120.07 |
| 3,826,397 A | | 7/1974 | Atkins | |
| 3,828,962 A | | 8/1974 | Atkins | |
| 4,179,044 A | | 12/1979 | Fitte | |
| 4,724,116 A | | 2/1988 | Aoki | |
| 4,779,749 A | | 10/1988 | Geiger | |
| 4,884,703 A | * | 12/1989 | O'Meara | 215/6 |
| 5,135,702 A | | 8/1992 | Eales | |
| 5,154,917 A | * | 10/1992 | Ibrahim et al. | 424/44 |
| 5,252,312 A | * | 10/1993 | Gentile et al. | 424/44 |
| 5,398,828 A | | 3/1995 | Valyi | |
| 5,482,170 A | * | 1/1996 | Semersky et al. | 215/6 |
| 5,573,143 A | | 11/1996 | Deardurff et al. | |
| 5,579,937 A | | 12/1996 | Valyi | |
| 5,753,289 A | * | 5/1998 | Ness | 426/394 |
| 5,804,227 A | | 9/1998 | Deardurff et al. | |
| 5,837,170 A | | 11/1998 | Valyi | |
| 5,848,717 A | | 12/1998 | Bosl et al. | |
| 5,849,241 A | | 12/1998 | Connan | |
| 5,882,574 A | | 3/1999 | Geisinger | |
| 6,341,716 B1 | * | 1/2002 | Goettner et al. | 222/94 |
| 6,412,660 B1 | * | 7/2002 | Bouix et al. | 222/94 |
| 6,450,351 B1 | * | 9/2002 | Thompson | 215/6 |
| 6,499,614 B1 | * | 12/2002 | Thompson | 215/6 |

* cited by examiner

*Primary Examiner*—Nathan J. Newhouse
*Assistant Examiner*—Niki M. Eloshway

(57) ABSTRACT

A one-piece integrally molded container includes a finish having a deck and a pair of outlet openings surrounded by associated annular walls. A peripheral ring extends upwardly from the deck, and has a radial lip that helps retain the container in the mold tooling during the forming operation. The finish has a radial bead over which a bead on the inside diameter of a closure skirt snaps to secure the closure to the container. Annular walls on the closure surrounding the closure dispensing openings are received in plug sealing engagement within the annular walls surrounding the outlet openings on the container finish deck.

8 Claims, 4 Drawing Sheets

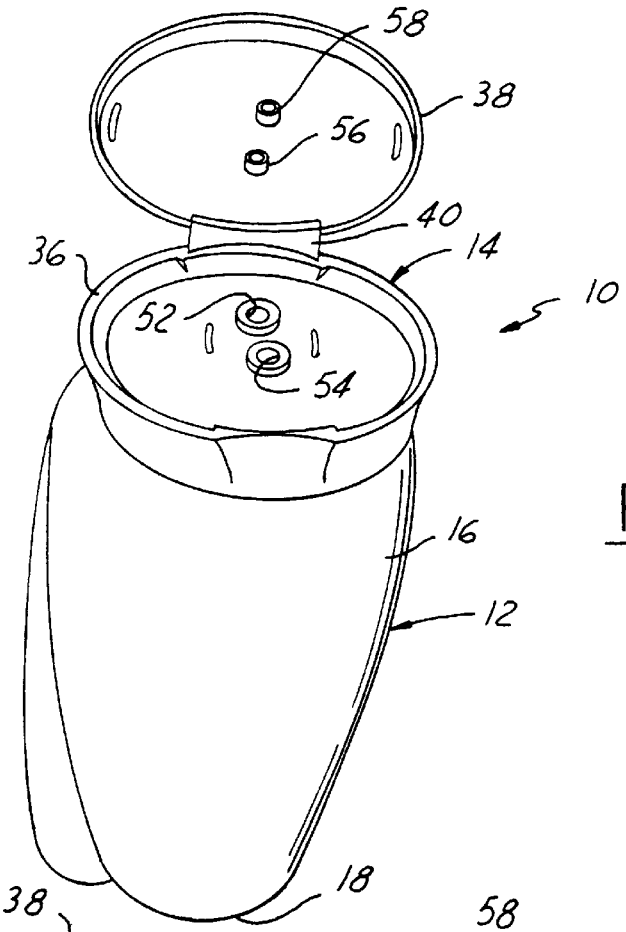
FIG.1
FIG.2
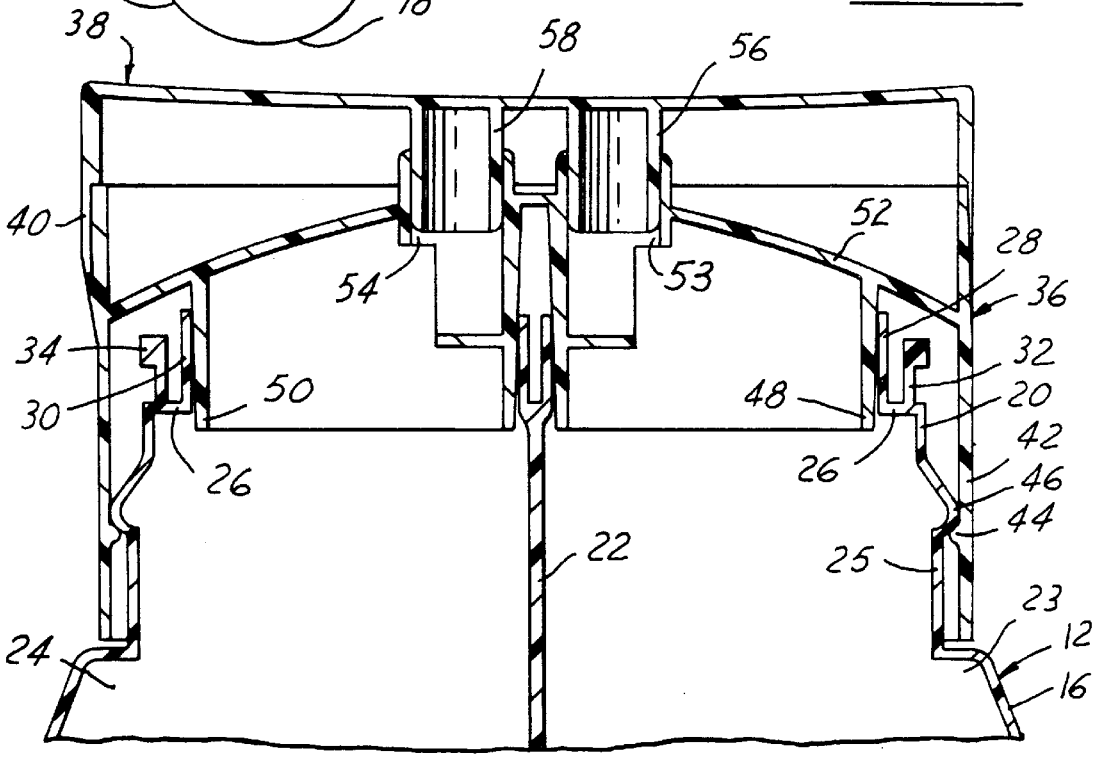

DUAL-CHAMBER CONTAINER AND CLOSURE PACKAGE

The present invention is directed to dual-chamber containers, and container and closure packages.

Reference is made to the concurrently filed co-pending application of Richard R. Johnson and Michael Hsieh Serial No. 09/961,961 and assigned to the assignee hereof.

BACKGROUND AND SUMMARY OF THE INVENTION

It has heretofore been proposed to provide a dual-chamber container by extrusion blow molding separate container sections and then securing the sections to each other to form a unitary container assembly. U.S. Pat. No. 5,823,391 is exemplary of this technology.

A dual-chamber container in accordance with one aspect of a presently preferred embodiment of the invention includes a hollow body having a perpherial sidewall, a closed bottom and a dividing wall or web extending through the body. A container finish is integrally molded to the body, and has a deck with a rim coupled to the peripheral sidewall and a pair of spaced outlet openings. The dividing wall of the container body is molded to an underside of the deck between the outlet openings. In the preferred embodiment of the invention, an annular wall extends from the deck around each of the outlet openings for receipt of plug seals on a closure secured to the finish. The preferred embodiment of the invention also includes a radial bead around the finish for snap-receipt of a closure on the finish. An outer ring extends axially from a peripheral edge of the deck in a direction opposite from the sidewall, and a lip extends radially outwardly from the ring at the end of the ring spaced from the deck The deck, annular wall and ring preferably have identical wall thicknesses for enhanced control of material shrinkage and reducing manufacturing cycle time due to improved cooling of the molded part.

A dual-chamber closure and container package in accordance with another aspect of the invention includes a container having a hollow body with a peripheral sidewall, a closed bottom and a dividing wall extending through the body. A container finish is integrally molded to the body, and has a deck with a rim coupled to the peripheral wall of the container body and a pair of spaced outlet openings in registry with the respective chambers defined by the dividing wall. The dividing wall or web is integrally molded to the underside of the deck between the outlet openings. A closure is secured to the container finish, and has dispensing openings surrounded by annular walls in plug sealing engagement with the outlet openings in the container deck. The closure preferably is secured to the container by respective radial beads in snap-fit engagement with each other.

A method of making a one-piece dual-chamber plastic container in accordance with a further aspect of the invention includes injection molding the container finish having a deck and a pair of spaced outlet openings in the deck. A tubular body is extruded from the finish having a peripheral wall and a central web extending from the deck between the openings and dividing the body into separate chambers in registry with the outlet openings in the deck. The tubular body is captured between opposed mold segments, and the peripheral wall is blown to the confines of the mold segments by application of air to the chambers through the outlet openings. The container is then removed from the mold segments. Injection molding of the container finish is preferably carried out in finish injection mold tooling, and the finish preferably includes an annular ring extending axially from the deck and a lip extending radially outwardly from the ring for helping to retain the finish in the finish mold tooling as the tube is extruded from the finish. The deck, the annular walls on the deck that define the outlet openings and the annular ring that surrounds the deck preferably have identical wall thicknesses for improving control of material shrinkage and reducing cycle time due to better cooling of the container as molded.

BRIEF DESCRIPTION OF THE DRAWINGS

The invention, together with additional objects, features and advantages thereof, will be best understood from the following description, the appended claims and the accompanying drawings in which:

FIG. 1 is a perspective view of a container and closure package in accordance with a presently preferred implementation of the invention;

FIG. 2 is a fragmentary sectional view that laterally bisects the container and closure package in FIG. 1;

DETAILED DESCRIPTION OF PREFERRED EMBODIMENTS

Figure 3:
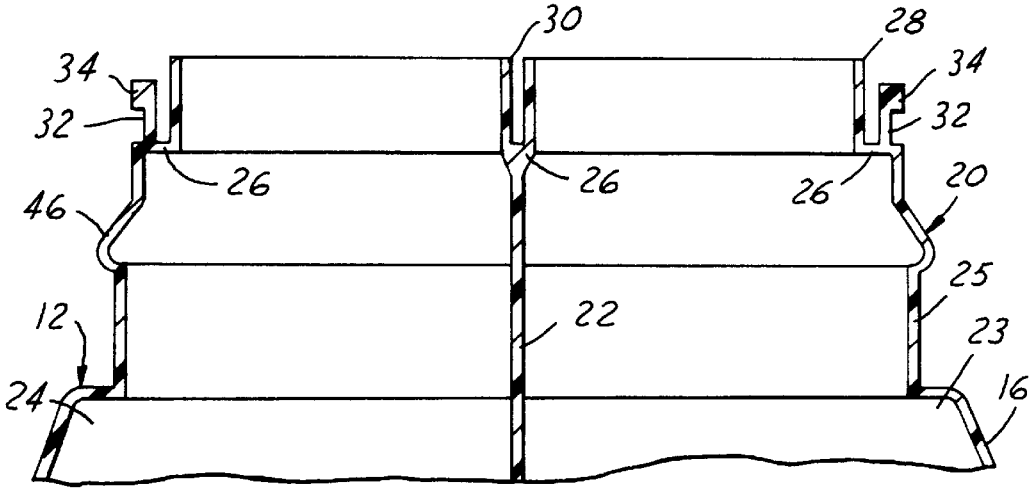
FIG. 3 is a fragmentary sectional view that laterally bisects the container finish in the embodiment of FIGS. 1 and 2.

FIGS. 1–3 illustrate a container and closure package 10 in accordance with a presently preferred embodiment of the invention as comprising a one-piece integrally molded dual-chamber plastic container 12 and a closure 14 secured to the container. Container 12 has a hollow body with a perpherial sidewall 16, a closed bottom 18 and a container finish 20 to which closure 14 is secured. An imperforate central web or wall 22 extends from finish 20 to closed bottom 18 so as to divide container 12 into dual adjacent chambers 23, 24. Finish 20 includes a wall 25 extending upwardly from sidewall 16. A flat deck 26 extends across the upper end of wall 25 spaced sidewall 16. A pair of annular walls 28, 30 extend upwardly from deck 26 to form a pair of outlet openings in respective registry with chambers 23, 24 of container 12. (It will be appreciated that directional adjectives such as "upper" and "upward" are used by way of description and not by way of limitation with respect to the orientation of the container and closure illustrated in FIGS. 1–3.) Wall 22 extends from the underside of deck 26 between annular outlet-forming walls 28, 30. An outer ring 32 extends axially from deck 26 surrounding walls 28, 30. A lip 34 extends radially outwardly from the upper end of ring 32.

Closure 14 (FIGS. 1 and 2) includes a base 36 secured to container finish 20, and a lid 38 coupled to base 36 by an integral hinge 40. Closure base 36 has a perpherial wall 42 with a radially inwardly extending bead 44 that is received by snap-fit over a radially outwardly extending bead 46 on container finish wall 25. Beads 44, 46 may be circumferentially continuous or segmented. A pair of annular walls 48, 50 extend downwardly from a base wall 52 of base 36 in plug-sealing engagement with a container finish annular walls 28, 30 respectively. A pair of outlet openings 53, 54 are formed in closure base wall 52, and an associated pair of plug seals 56, 58 extend from closure lid 38. To dispense products from within package 10, closure lid 38 is first moved to the open position as illustrated in FIG. 1. Container sidewall 16 is then squeezed to dispense product from within chamber 23, 24 simultaneously. The package may be employed for two-part body wash or shampoo, for example. The products do not mix until after emerging from openings 53, 54. Container sidewall 16 may be of translucent construction to permit a user to observe the levels of product within the respective chambers. It is preferable that wall 22 should be sufficiently thin, preferably no more than 0.015 inch thick, to permit limited self-leveling between the respective chambers by flexure of the web.

Figure 4:
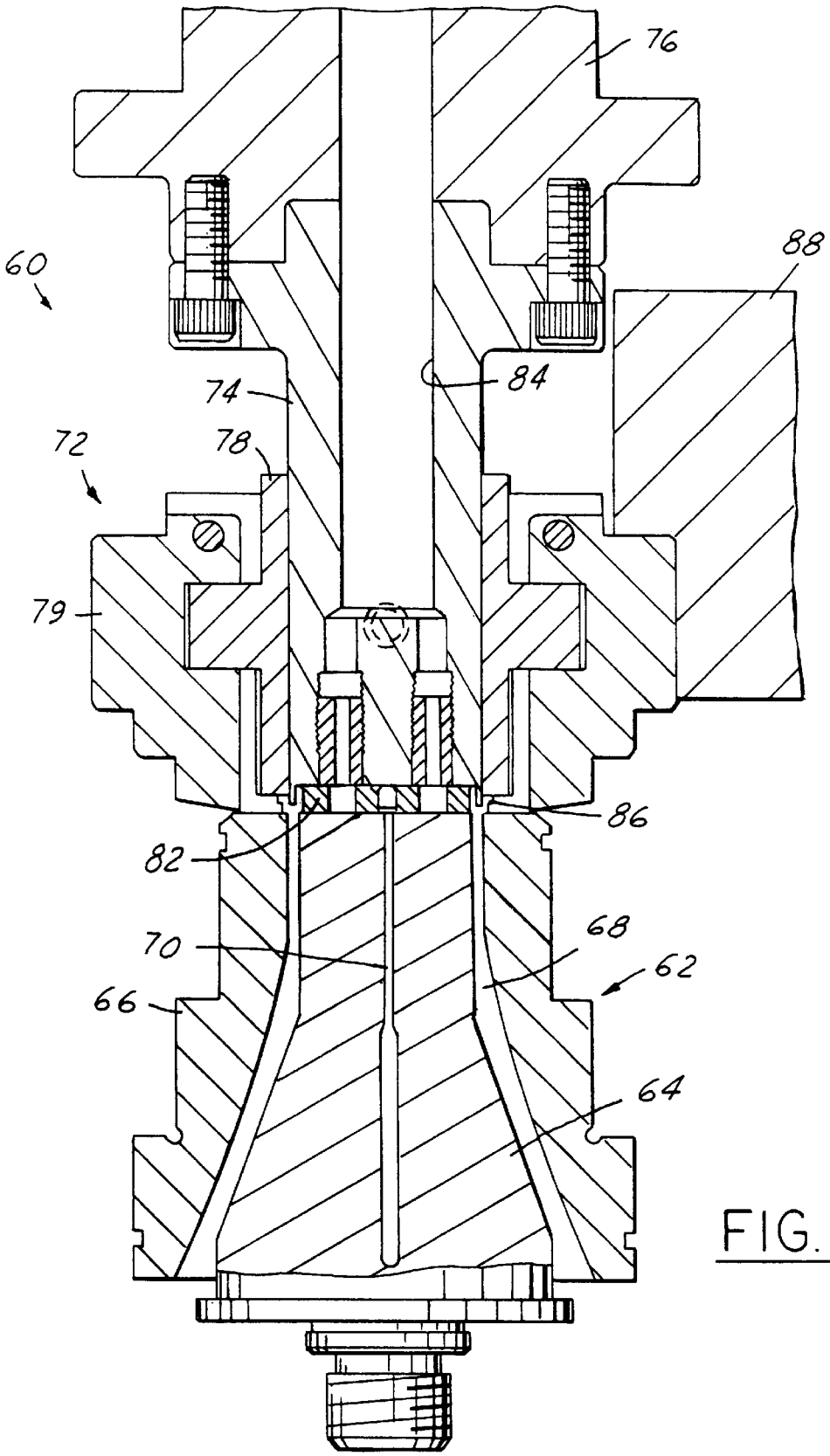
FIGS. 4 and 5 are fragmentary views that illustrates tooling for fabricating the container of FIGS. 1–3.
Figure 5:
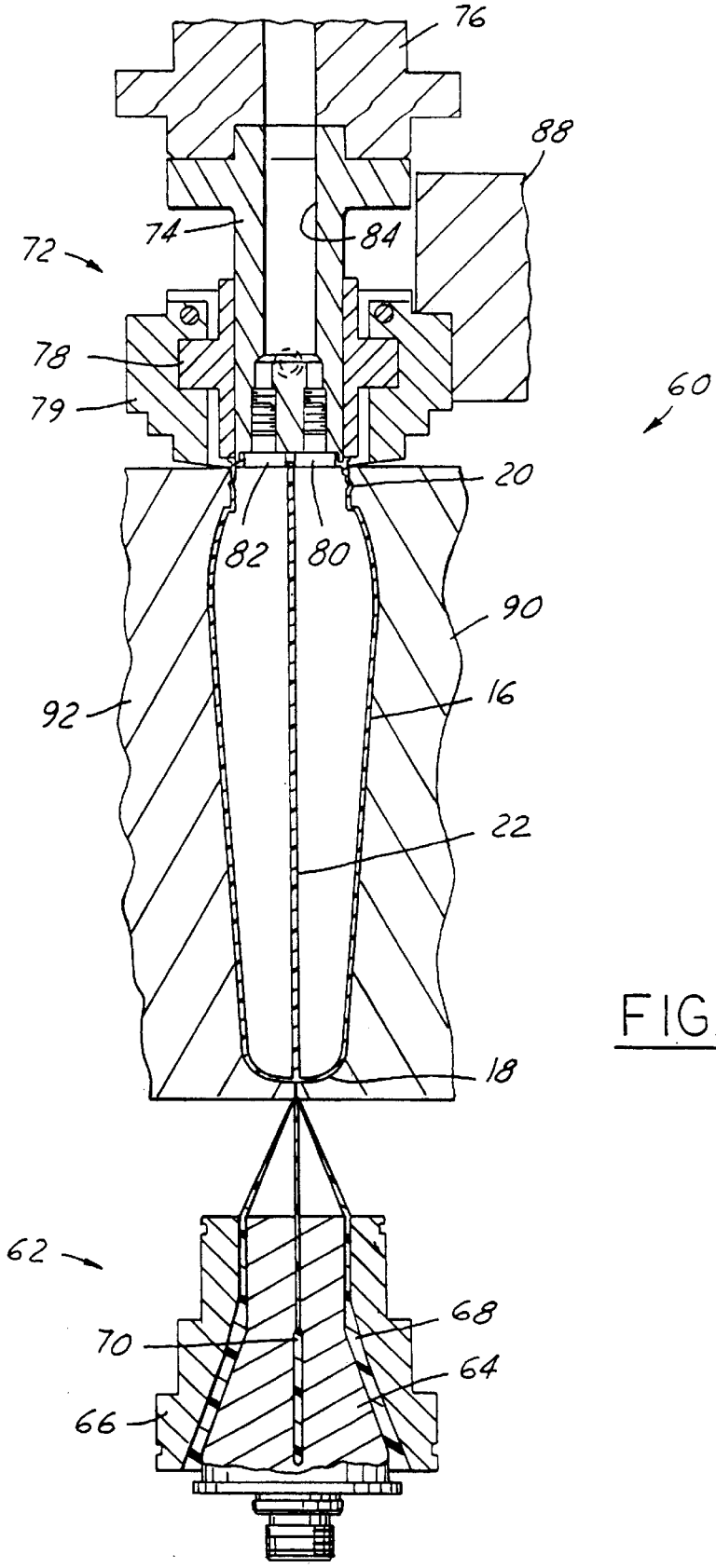

FIGS. 4 and 5 illustrate a method and apparatus 60 for forming container 12 in accordance with a presently preferred implementation of the invention. Mold apparatus 60 preferably includes extrusion tooling 62 and finish mold tooling 72. Extrusion tooling 62 includes a mandrel tip 64 surrounded by an orifice bushing 66. There is an annular space 68 provided between the opposing surfaces of mandrel tip 64 and orifice bushing 66, through which plastic is extruded upwardly (in the orientation of FIGS. 4 and 5) from a suitable extruder (not shown). A central passage 70 extends diametrically through mandrel tip 64 for extruding container wall 22. Finish mold tooling 72 includes a mold core 74 mounted on a mold core insert adapter 76. A finish insert 78 is secured to a neck ring 79 and supports mold core 74. A pair of finish plugs 80, 82 are mounted at the lower end of mold core 74. An air passage 84 has an inlet at the upper end of mold core 74, extends longitudinally through mold core 74, branches within mold core 74, and then is directed through the hollow interiors of insert plug 80, 82.

With finish mold tooling 72 in opposed abutment with extrusion tooling 62 as illustrated in FIG. 4, plastic material extruded through passage 68, 70 flows into the finish mold cavity 86 formed between neck ring 79, finish insert 78, mold core 74 and plugs 80, 82. This cavity 86 forms deck 26 (FIG. 3), annular outlet-forming walls 28, 30, outer ring 32 and lip 34. Neck ring holder 88 is then employed to lift finish mold tooling 72 axially upwardly relative to extrusion tooling 62 while plastic is continuously extruded through passages 68, 70. Lip 34 helps retain the container finish in finish mold tooling 72 during this process. A tube is thus extruded between finish mold tooling 72 and extrusion tooling 62 having a circumferentially continuous perpherial wall formed by plastic flowing through passage 68 and a central web or wall formed by plastic flowing through passage 70. This wall is integral with and extends from the underside of the finish deck between the outlet openings, and is integrally extruded with the peripheral sidewall. At the upper position of finish mold tooling 72 (FIG. 5), a pair of mold segments 90, 92 are brought laterally inwardly to capture the extruded tube. The tube is pinched off adjacent to extrusion tooling 62 to form the closed container bottom. Air is then fed through passage 84 and the hollow interiors of plugs 80, 82, simultaneously and at equal pressures, to the chambers of the extruded tube to mold the extruded tube to the confines of mold segments 90, 92. Mold segments 90, 92 are then opened and the completed container is removed from the mold tooling. Finish mold tooling 72 is then brought back down into abutment with extrusion mold tooling 62, and the process is repeated. The method and apparatus of the invention have been disclosed in conjunction with a container injection/extrusion/blow-molding process. Processes of this type are illustrated, for example, in U.S. Pat. Nos. 2,804,654, 3,008,192 and 3,040,376. The container and closure package has also been illustrated in conjunction with a closure adapted for simultaneous dispensing of the products within the container chambers. However, the closure can be fabricated for selectively dispensing products either separately or simultaneously, and still be within the scope of the present invention in its broadest aspect. It is currently preferred that wall 22 be centrally disposed within the container and divide the container into chambers of equal volume. However, wall 22 could be extruded and blown off-center without departing from the invention in its broadest aspects. The invention has been disclosed in conjunction with a number of modifications and variations. Other modifications and variations will readily suggest themselves to persons of ordinary skill in the art. The invention is intended to embrace all such modifications and variations as fall within the spirit and broad scope of the appended claims.

I claim:

1. A dual-chamber container that includes:

a one-piece integrally molded hollow plastic body having a peripheral sidewall, a closed bottom and a dividing wall extending through said body, and a finish integrally molded to said body having a deck with a rim coupled to said peripheral sidewall and a pair of spaced outlet openings, said dividing wall being molded to an underside of said deck between said outlet openings, annular walls extending from said deck around each of said outlet openings for receipt of plug seals on a closure secured to said finish, and an outer ring extending axially from said deck in a direction opposite from said peripheral sidewall and spaced radially outwardly of said annular walls.

2. The container set forth in claim 1 further comprising a radial bead around said finish for snap receipt of a closure on said finish.

3. The container set forth in claim 1 further comprising a lip extending radially outwardly from said ring at an end of said ring spaced from said deck.

4. The container set forth in claim 1 wherein said deck, said annular walls and ring have identical wall thicknesses.

5. The container set forth in claim 1 wherein said finish further includes an external bead for snap-receipt of a closure on said finish.

6. A dual-chamber closure and container package that includes:

a container comprising a hollow body having a peripheral sidewall, a closed bottom and a dividing wall extending through said body, and a finish integrally molded to said body having a deck with a rim coupled to said peripheral wall and a pair of spaced outlet openings, said dividing wall being molded to an underside of said deck between said outlet openings, and a closure secured to said finish, said closure having dispensing openings surrounded by first annular walls in plug sealing engagement with said outlet openings, said container having second annular walls extending from said deck around each of said outlet openings for plug sealing receipt of said first annular walls on said closure.

7. The package set forth in claim 6 further comprising a first radial bead around said finish and a second radial bead around said closure received by snap fit over said first bead on said finish.

8. The package set forth in claim 6 wherein said closure includes a base secured to said finish, said base having said deck said dispensing openings and said first annular walls, and a lid hinged to said base, said lid having plug seals for engagement within said dispensing openings in a closed position of said lid over sad base.

* * * * *